United States Patent [19]

Diaz

[11] Patent Number: 4,815,221

[45] Date of Patent: Mar. 28, 1989

[54] SHOE WITH ENERGY CONTROL SYSTEM

[75] Inventor: Juan A. Diaz, Weymouth, Mass.

[73] Assignee: Reebok International Ltd., Canton, Mass.

[21] Appl. No.: 11,732

[22] Filed: Feb. 6, 1987

[51] Int. Cl.[4] ..... A43B 13/37; A43B 13/18; A43B 21/26

[52] U.S. Cl. ..... 36/27; 36/28; 36/37; 36/38

[58] Field of Search ..... 36/27, 28, 37, 38, 35 R, 36/7.8

[56] References Cited

U.S. PATENT DOCUMENTS

| | | | |
|---|---|---|---|
| 607,086 | 7/1898 | Safford | 36/37 |
| 614,688 | 11/1898 | Barber | 36/37 |
| 617,701 | 1/1899 | Goldberg | 36/27 X |
| 1,172,613 | 2/1916 | Larsen | 36/37 |
| 2,078,551 | 4/1937 | Williams | 36/38 |
| 2,080,499 | 5/1937 | Nathensohn | 36/37 X |
| 2,157,912 | 5/1939 | Nabokin | 36/37 |
| 4,391,048 | 7/1983 | Lutz | 36/37 X |
| 4,638,575 | 1/1987 | Illustrato | 36/38 |

FOREIGN PATENT DOCUMENTS

| | | | |
|---|---|---|---|
| 431023 | 6/1935 | United Kingdom | 36/28 |

OTHER PUBLICATIONS

HYTREL in Footwear, cover and three pages, date unknown.

HYTREL Polyester Elastomer, 1 page, date unknown.

HYTREL Shoe Cushion Innersole Sample, date unknown.

*Primary Examiner*—John Petrakes

*Attorney, Agent, or Firm*—Saidman, Sterne, Kessler & Goldstein

[57] ABSTRACT

A shoe has a sole with an energy control system for shock absorption and for propulsion of the wearer. The energy control system includes a spring system and an overlying energy absorbing member located in a cavity in the midsole. The spring system includes a spring plate with a plurality of curved, resilient strips projecting there from. The resilient strips are deformed under the load of the foot of the wearer and then return to their original shape as the foot is lifted and the lead is removed. A support rib at the rear of each resilient strip directs the released energy in a forward force component as the strip returns to its uncompressed shape. An energy absorbing member, preferably a layer of urethane is provided over the spring system.

8 Claims, 4 Drawing Sheets

SHOE WITH ENERGY CONTROL SYSTEM

FIELD OF THE INVENTION

This invention relates to the construction of footwear and, more particularly, to a sole with an energy control system for shock absorption and for propulsion of the wearer. The sole with the energy control system is intended for use in athletic shoes, but is not limited to such use.

BACKGROUND OF THE INVENTION

Each time the foot of a walker or a runner contacts the ground, considerable shock force is transmitted through the shoe to the wearer's foot. After a time, this shock force can result in fatigue and discomfort. Various shock absorbing sole materials have been utilized to absorb at least a portion of the shock and to thereby overcome this problem. In addition to shock absorption, the shoe must also act as a stable platform for each step. Preferably, the sole should provide some propulsion of the wearer's foot as the foot is lifted and the sole returns to its original shape. Such propulsion can give the effect of reducing the energy required to be expanded by the wearer.

It is an object of the present invention to provide footwear having an improved sole construction.

It is a further object of the present invention to provide footwear having a sole with a support system which provides both energy absorbing and energy return functions.

SUMMARY OF THE INVENTION

According to the present invention, these and other objects and advantages are achieved in footwear comprising an upper and a sole, the sole having an energy control system located in a cavity of the sole for interacting with the foot of the wearer. The energy control system includes a spring system and an overlying energy absorbing member.

The spring system includes a spring plate having a plurality of resilient and compressible projections extending from the plate and distributed over its surface. In a preferred embodiment, each of the compressible projections includes a curved, resilient strip attached at each end to the spring plate.

It is preferred that the spring system include means for giving the effect of producing a forward force component and the wearer's foot. To accomplish this the resilient strips are aligned longitudinally and a support rib is secured between the rear of the resilient strip and the spring plate. The support rib acts to cause a forward force component to be exerted on the wearer's foot when the resilient projection releases the potential energy generated by the load of the foot.

The spring plate and resilient projections are preferably formed as an integral piece and may be molded. The overlying energy absorbing member is typically a layer of urethane or other suitable cushioning material and is capable of absorbing impact energy.

BRIEF DESCRIPTION OF THE DRAWINGS

For a better understanding of the present invention together with other and further objects, advantages and capabilities thereof, reference is made to the accompanying drawings in which.

DETAILED DESCRIPTION OF THE INVENTION

Figure 1:
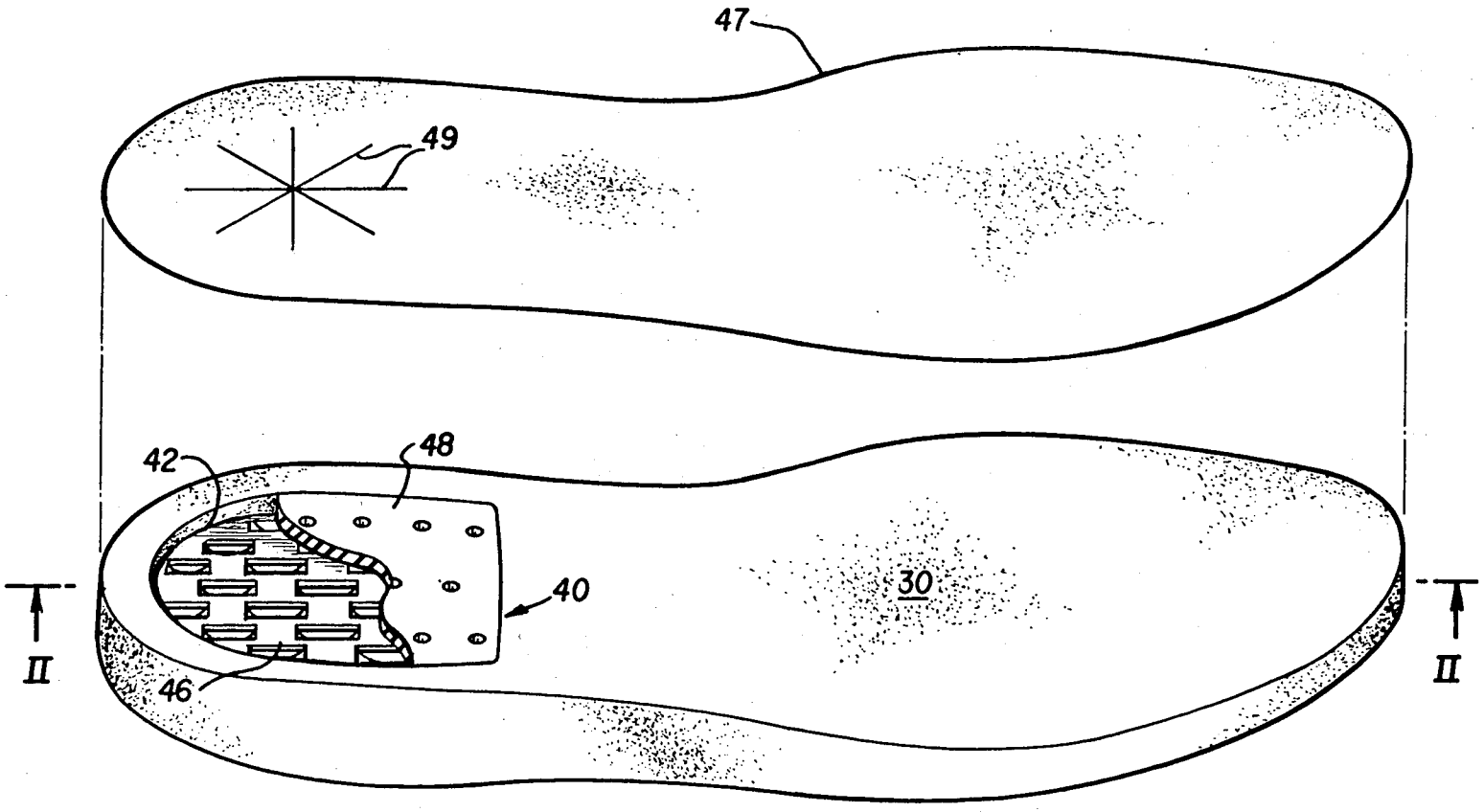
FIG. 1 is a perspective view of a midsole with the pad member partially cut away to illustrate the energy control system of the present invention.

A sole member 30 incorporating an energy control system in accordance with the present invention is shown in FIG. 1.

Figure 2:
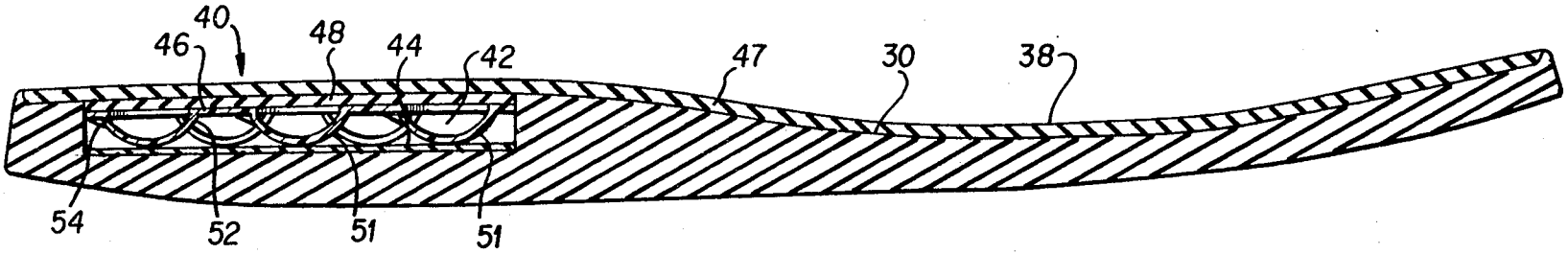
FIG. 2 is a longitudinal cross-sectional view of a midsole illustrating the energy control system.
Figure 3:
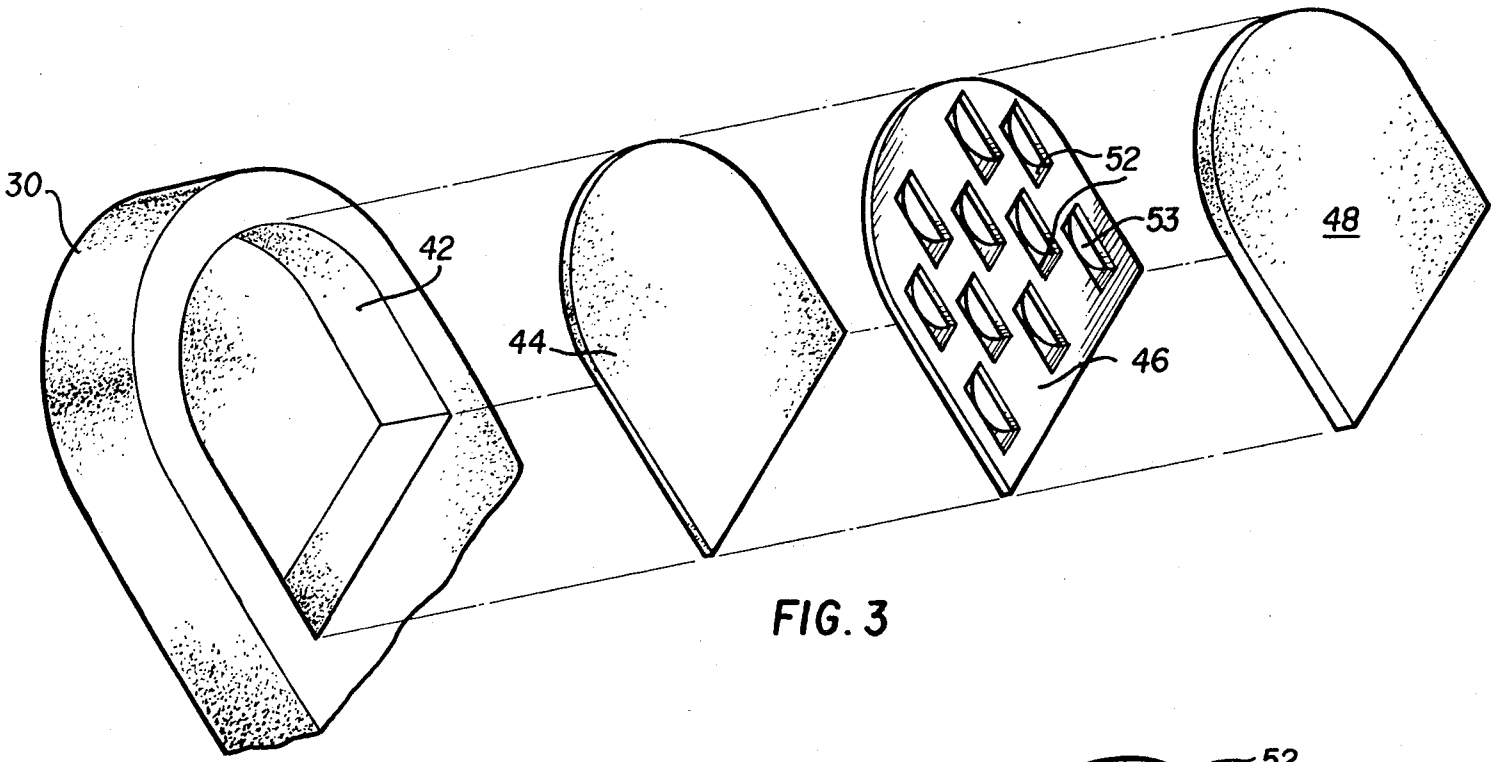
FIG. 3 is an exploded perspective view of an embodiment of the energy control system of the present invention.

Sole member 30 in accordance with the present invention is preferably molded of an elastomeric material such as ethylvinylacetate (EVA). An energy control system 40 according to the invention may, in one embodiment, be located in the heel region. FIG. 1 shows energy control system 40 with pad member 48 partially cut away to better illustrate its components. For further illustration energy control system 40 is shown in a longitudinal cross-section in FIG. 2 and in an exploded view in FIG. 3.

In one embodiment where an energy control system according to the invention is provided in the heel area of a sole member, a cavity 42 is molded or cut into sole member 30. A relatively rigid pressure plate 44 is positioned at the bottom of the cavity 42 and a spring plate 46 is positioned on top of the pressure plate 44 with projections 52 extending downwardly and contacting pressure plate 44. Of course, those skilled in the art will realize that the disposition of the spring plate 46 and pressure plate 44 may be reversed so that spring plate 46 is positioned at the bottom of cavity 42 with projections 52 extending upwardly and pressure plate 44 on top of projections 52 of spring plate 46. In the preferred embodiment of the invention, the energy control system may also include a resilient pad 48 positioned over the spring system 41.

An insole board 47 may be positioned between the midsole of a shoe and the foot of the wearer as shown in FIG. 1. A plurality of slits 49 in insole board 47 are located above energy control system 40 to permit the insole board 47 to flex with the action of energy control system 40. A ray or star pattern is illustrated, but other patterns are suitable.

Energy control system 40 is dimensioned to be flush with the top surface of the sole member 30. For example, in one preferred embodiment, the cavity 42 is 12 mm in depth and is spaced inwardly by 12 mm from the periphery of the edge of sole member 30. The energy control system 40 is preferably in the range between 4 mm and 22 mm in thickness.

Figure 4:
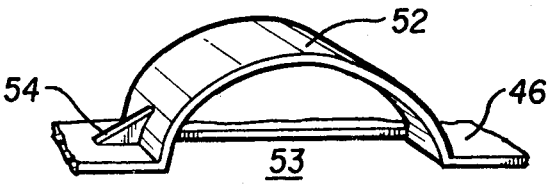
FIG. 4 is an enlarged view of a preferred embodiment of a compressible projection of the spring system.

Spring plate 46 has a plurality of compressible projections 52 distributed over its surface. In the present example, the projections 52 are resilient, curved strips attached at both ends to spring plate 46. An enlarged view of one of the projection 52 is shown in FIG. 4. When a compressive force is applied to the projections 52 perpendicular to the plane of spring plate 46, the strips deform and then spring back to their original shape when the force is removed. As a result, each of the projections 52 acts as a leaf spring. In a preferred embodiment, each curved strip is about 15 mm between points of attachment, 6 mm wide and 8 mm in height at the highest point. Spring plate 46 and projections 52 are preferably injection molded as an integral unitary piece. The material of the spring plate 46 and projections 52 is preferably a polyester elastomer or other polymeric material having similar spring-like properties. Hytrel 7246 manufactured by Dupont is an example of a polyester elastomer suitable for spring plate 46 and projections 52. Spring plate 46 and projections 52 have in one embodiment a thickness of about 1 millimeter.

In a further feature of the invention as shown in FIG. 4, the projections 52 are aligned longitudinally in sole member 30. The rear portion of at least several of the projections 52 are rigidified or reinforced by a support rib 54. Support 54. Support ribs 54 are preferably molded into the integral spring plate 46 and projections 52 and comprise a reinforcing rib between the surface of spring plate 46 and the rear of projection 52 near the point where it attaches to or extends from spring plate 46. Because of the support ribs 54, projections 52 tend to deform more toward the front and less toward the rear under a compressive load. When projection 52 spring back to their original shape as the foot is lifted, the return force has a component in the forward direction thereby tending to propel the wearer forward.

Pressure plate 44 can be any thin, relatively rigid material and functions as a surface against which the projections 52 press during compression. When spring system 41 is set in a relatively incompressible material, pressure plate 44 may be omitted.

The energy absorbing member 48 is preferably a layer of cured urethane, polyurethane or other polymeric material having good shock-absorbing properties. In a preferred embodiment, member 48 is urethane about 8 mm thick and having a hardness of about 30 Asker C durometer. Member 48 preferably has a hardness in the range between 10 and 50 Asker C durometer and a thickness in the range between 3 mm and 12 mm to produce the desired energy absorbing characteristics. The hardness values specified herein are measured at a temperature of 75° F.±5° F. in a dry environment. The depth of cavity 42 is selected so that the top of energy absorbing member 48 is flush with the top surface of the sole member 30 when the energy control system 40 is installed.

The energy control system described hereinabove provides the dual functions of absorbing energy upon impact and returning energy to the foot of the wearer as the foot is lifted, thereb reducing fatigue and producing a very comfortable walking shoe. In addition, the energy return function provides a forward force component which tends to propel the wearer in a forward direction and to reduce the energy required to be expended by the wearer.

Figure 5:
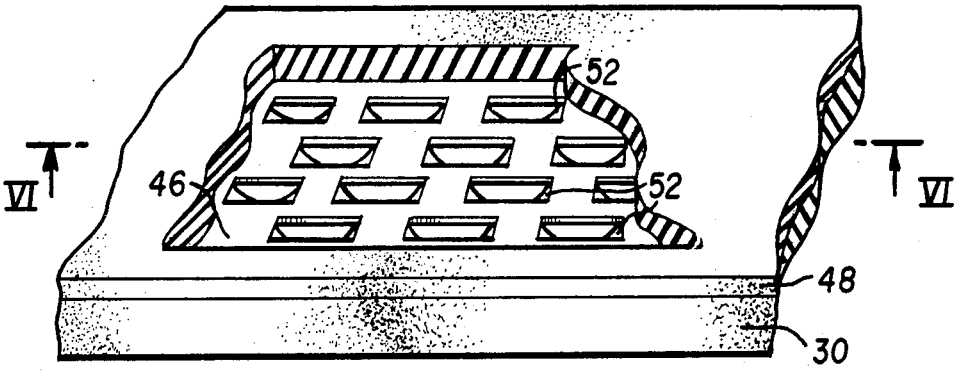
FIG. 5 is a perspective view of a sole member containing an energy control system according to the invention with the energy absorbing member partially cut away.
Figure 6:
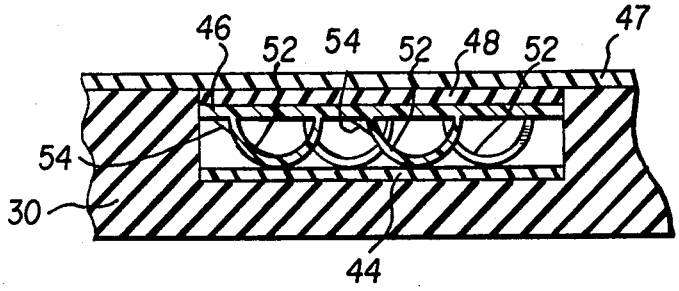
FIG. 6 is a cross section view taken along line VI—VI of FIG. 5.

The energy control system 40 may be located in the heel region of the sole member 30. An energy control system according to the invention can also be provided in the forefoot region of the sole or it can be provided over a major portion of the sole from heel to toe. FIGS. 5 and 6 illustrate that an energy control system according to the invention can be readily located in any part of a sole member. In addition, it will be understood that the configuration of spring plate 46 can take many forms, although it is preferably provided with a plurality of compressible projection 52 distributed over its surface. Furthermore, the spring system can be reversed so that the projections 52 extend upwardly and pressure plate 44 is positioned between the projections 52 and the energy absorbing member 48.

It should be understood that the materials described herein are given by way of example and that a wide variety of materials can be utilized to construct a sole having an energy control system in accordance with the present invention. The spring constant of the spring member and the energy absorbing characteristics of energy absorbing member 48 can be varied independently over a wide range to provide a desired combination of characteristics for a particular application.

While there has been shown and described what is at present considered the preferred embodiments of the present invention, it will be obvious to those skilled in the art that various changes and modifications may be made therein without departig from the scope of the invention as defined by the appended claims.

What is claimed is:

1. An energy control system for shoes, said energy control system for absorbing and releasing energy, said energy control system comprising a sole member having a cavity for receiving said energy control system and a spring system located in said cavity, said spring system comprising:

a spring plate;

a plurality of resilient and compressible projections extending from said spring plate, said resilient and compressible projections comprising curved strips attached at both ends to said spring plate and oriented longitudinally with respect to said sole member; and directing means for directing the release of absorbed energy in a specific direction, said directing means comprising a stiffening member at the rear of at least one of said curved strips.

2. The energy control system of claim 1 wherein said stiffening member comprises a rib attached between said projection and said spring plate.

3. The energy control system of claim 2 wherein said spring plate, said projections and said ribs are integrally formed.

4. The energy control system of claim 3 wherein said spring plate, said projections and said ribs are integrally formed of a polyester elastomer.

5. An energy control system for shoes, said energy control system for absorbing and releasing energy, said energy control system comprising:

a sole member having a cavity for receiving said energy control system;

a spring system located in said cavity, said spring system comprising a spring plate, a plurality of resilient and compressible curved stripes oriented longitudinally with respect to said sole member extending from said spring plate and attached at both ends to said spring plate, and directing means comprising a stiffening member at the rear of at least one of said curved strips for directing the release of absorbed energy in a specific direction; and an energy absorbing member overlaying said spring system for cushioning and shock absorbing.

6. An energy control system for shoes, said energy control system for absorbing and releasing energy, said energy control system comprising:

a sole member having a cavity for receiving said energy control system;

a spring system located in said cavity, said spring system comprising a spring plate, a plurality of resilient and compressible curved strips oriented longitudinally with respect to said sole member extending from said spring plate and attached at both ends to said spring plate, and directing means comprising a rib attached between the rear of at least one of said curved strips and said spring plte for directing the release of absorbed energy in a specific direction; and an energy absorbing member overlaying said spring system for cushioning and shock absorbing.

7. An energy control system for shoes, said energy control system for absorbing and releasing energy, said energy control system comprising:

a sole member having a cavity for receiving said energy control system;

a spring system located in said cavity, said spring system comprising a spring plate, a plurality of resilient and compressible curved strips oriented longitudinally with respect to said sole member extending from said spring plate and attached at both ends to said spring plate, and directing means comprising a rib attached between the rear of at least one of said curved strips and said spring plate for directing the release of absorbed energy in a specific direction, wherein said spring plate, said curved strips and said ribs are integrally formed; and an energy absorbing member overlaying said spring system for cushioning and shock absorbing.

8. An energy control system for shoes, said energy control system for absorbing and releasing energy, said energy control system comprising:

a sole member having a cavity for receiving said energy control system;

a spring system located in said cavity, said spring system comprising a spring plate, a plurality of resilient and compressible curved strips oriented longitudinally with respect to said sole member extending from said spring plate and attached at both ends to said spring plate, and directing means comprising a rib attached between the rear of at least one of said curved strips and said spring plate for directing the release of abosrbed energy in a specific direction, wherein said spring plate, said curved strips and said ribs are integrally formed of a polyester elastomer; and an energy absorbing member overlaying said spring system for cushioning and shock absorbing.

* * * * *